US008257641B1

(12) United States Patent
Qi et al.

(10) Patent No.: US 8,257,641 B1
(45) Date of Patent: Sep. 4, 2012

(54) PROCESS OF MAKING CORE-SHEATH NANOFIBERS BY COAXIAL ELECTROSPINNING

(75) Inventors: Yu Qi, Oakville (CA); Carolyn Moorlag, Mississauga (CA); Qi Zhang, Mississauga (CA); Nan-Xing Hu, Oakville (CA)

(73) Assignee: Xerox Corporation, Norwalk, CT (US)

( * ) Notice: Subject to any disclaimer, the term of this patent is extended or adjusted under 35 U.S.C. 154(b) by 6 days.

(21) Appl. No.: 13/027,047

(22) Filed: Feb. 14, 2011

(51) Int. Cl.

| | |
|---|---|
| ***D01D 5/34*** | (2006.01) |
| ***D01D 10/02*** | (2006.01) |
| ***D01F 8/10*** | (2006.01) |
| ***D06M 10/00*** | (2006.01) |
| ***H05B 7/00*** | (2006.01) |

(52) U.S. Cl. ..... 264/465; 264/172.15; 264/211.15; 264/211.17

(58) Field of Classification Search ..... 264/172.15, 264/211.15, 211.17, 464, 465, 466, 484
See application file for complete search history.

(56) References Cited

U.S. PATENT DOCUMENTS

2010/0291182 A1* 11/2010 Palasis et al. ..... 424/426
2010/0297906 A1* 11/2010 Steckl et al. ..... 264/466 X

* cited by examiner

*Primary Examiner* — Leo B Tentoni
(74) *Attorney, Agent, or Firm* — MH2 Technology Law Group LLP

(57) ABSTRACT

Exemplary embodiments provide core-sheath nanofibers produced by coaxial electrospinning, fuser members comprising core-sheath nanofibers, and methods for forming core-sheath nanofibers that can include a core solution comprising a high performance polymer and sheath solutions comprising a solvent-soluble fluoropolymer or solvent-insoluble fluororesins and a sacrificial polymeric binder.

13 Claims, 8 Drawing Sheets

PROCESS OF MAKING CORE-SHEATH NANOFIBERS BY COAXIAL ELECTROSPINNING

DETAILED DESCRIPTION

1. Field of the Use

The present teachings relate generally to fuser members used in electrophotographic printing devices and, more particularly, to core-sheath nanofibers used for the topcoat layer of the fuser members.

2. Background

In a typical electrophotographic reproducing apparatus, a light image of an original to be copied is recorded in the form of an electrostatic latent image upon a photosensitive member. The latent image is subsequently rendered visible by application of electroscopic thermoplastic resin particles which are commonly referred to as toner. The visible toner image is then in a loose powdered form and is usually fused, using a fusing apparatus, upon a support, which may be an intermediate member, or a print medium such as plain paper.

Conventional fusing apparatuses include a fuser member and a pressure member, which may be configured to include a roll pair maintained in pressure contact or a belt member in pressure contact with a roll member. In a fusing process, heat may be applied by heating one or both of the fuser member and the pressure member.

Fuser members can be coated with layers (e.g., topcoat) of materials having low surface energy (to maintain good release properties), adequate flexibility, good thermal conductivity, and/or mechanical robustness (to extend fuser member life). However, few materials have all properties desired. Some materials having low surface energy often have relatively low mechanical strength, reducing fuser member life. Other materials having mechanical robustness can have poor thermal conductivity. Accordingly, combinations of materials must be selected carefully.

Conventional fusing technologies include application of fuser oils to the fuser member during the fusing operation in order to maintain good releasing properties of the fuser member. However, oil application can result in image offset if toner particles stick to the oil of the fuser member instead of adhering to the media. If the offset image is not cleaned, it may print onto the medium in the next revolution, resulting in unwanted image defects on the print. On the other hand, conventional fusing technologies include an oil-less fusing process, which removes the oil application step from the fusing operations and can avoid the image offset problems above. Oil-less fusing operations have been used for color printers and multi-functional copier-printers in small office and home office markets but not for all high speed products.

Additionally, paper-edge wear and scratch damage at the fuser surface are often observed during conventional fusing operations, due to lack of mechanical robustness of the topcoat materials used for conventional fuser members. For example, stress can be higher on a fuser member where paper edges are pressed against the roll. Over time, increased wear at the paper edge can cause grooves to become visible and tactile on the fuser member, resulting in poor toner fix. Additionally, continuous operation can contribute to scratches on the fuser member surface, leading to poor image quality. Increasing the mechanical robustness of the topcoat materials can reduce wear, scratching and other damage.

To lower manufacturing costs and extend lifetime of fuser members, it is desirable to provide a fuser member material with improved properties (e.g., low surface energy, adequate flexibility, good thermal conductivity, mechanical robustness, etc.)

SUMMARY

According to embodiments illustrated herein, there is provided methods of forming core-sheath nanofibers by coaxial electrospinning fuser members comprising core-sheath nanofibers, and core-sheath nanofibers produced by coaxial electrospinning.

According to one embodiment, there is provided a method of forming core-sheath nanofibers by coaxial electrospinning comprising providing a core solution comprising a high performance polymer selected from the group consisting of an organic polymer, an inorganic polymer, and combinations thereof; providing a sheath solution comprising a solvent-insoluble fluororesin, a sacrificial polymeric binder, and solvent; coaxial electrospinning the core and sheath solutions to form a plurality of core-sheath polymer nanofibers, wherein the core solution forms a polymer core and the sheath solution forms a polymer sheath surrounding the core; heating the core-sheath nanofibers to a first temperature ranging from about 100° C. to about 280° C.; and heating the core-sheath nanofibers to a second temperature ranging from about 285° C. to about 380° C.

According to another embodiment, there is provided a method of forming core-sheath nanofibers by coaxial electrospinning comprising providing a core solution comprising a high performance polymer selected from the group consisting of an organic polymer, an inorganic polymer, and combinations thereof; providing a sheath solution comprising a solvent-soluble fluoropolymer; coaxial electrospinning the core and sheath solutions to form a plurality of core-sheath polymer nanofibers, wherein the core solution forms a polymer core and the sheath solution forms a polymer sheath surrounding the core; heating the core-sheath nanofibers to a first temperature ranging from about 100° C. to about 280° C.; and heating the core-sheath nanofibers to a second temperature ranging from about 285° C. to about 380° C.

According to yet another embodiment, there is provided a fuser member comprising a substrate; and a topcoat layer disposed over the substrate, wherein the topcoat layer comprises an electrospun layer comprising a plurality of solid core-sheath nanofibers entangled to form a non-woven fabric, each of the core-sheath nanofibers comprising a core surrounded by a sheath, wherein the core comprises a high performance polymer selected from the group consisting of an organic polymer, an inorganic polymer, and combinations thereof; and wherein the sheath comprises a solvent-insoluble fluororesin, a solvent-soluble fluoropolymer, and combinations thereof.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Exemplary embodiments provide materials and methods for producing a core-sheath polymer nanofiber, a non-woven fabric, a fuser member, and a fusing apparatus used in electrophotographic printing devices. The non-woven fabric can include an electrospun layer having a plurality of core-sheath polymer nanofibers. In one embodiment, the non-woven fabric can be used as a topcoat layer of a fuser member to provide desirable surface properties suitable for fusing processes.

As disclosed herein, the term "non-woven fabric" refers to a bonded sheet or a bonded web formed by entangling fibers or filaments or perforating films together. The bonding in the non-woven fabric can be a mechanical, thermal, and/or chemical bonding. Note that the non-woven fabrics are not made by weaving or knitting and do not require converting the fibers to yarn. The nonwoven fabrics can be substantially flat and/or porous. For example, the non-woven fabrics can be formed by an electrospinning process and/or can be in nanoscale.

Figure 1:
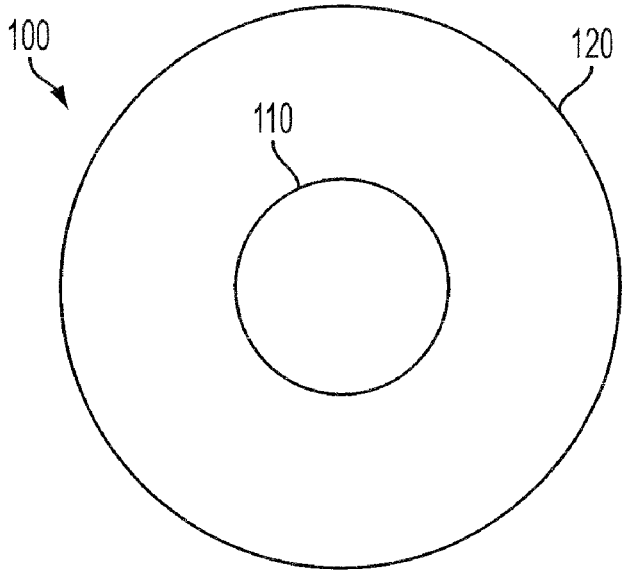
FIG. 1 depicts a cross-section of an exemplary core-sheath nanofiber in accordance with various embodiments of the present teachings.

FIG. 1 depicts a cross-section of an exemplary core-sheath nanofiber in accordance with various embodiments of the present teachings. Specifically, FIG. 1 depicts a cross-section of an exemplary core-sheath nanofiber 100 having a core 110 surrounded by a sheath 120, forming a "core-sheath" structure.

Figure 3A:
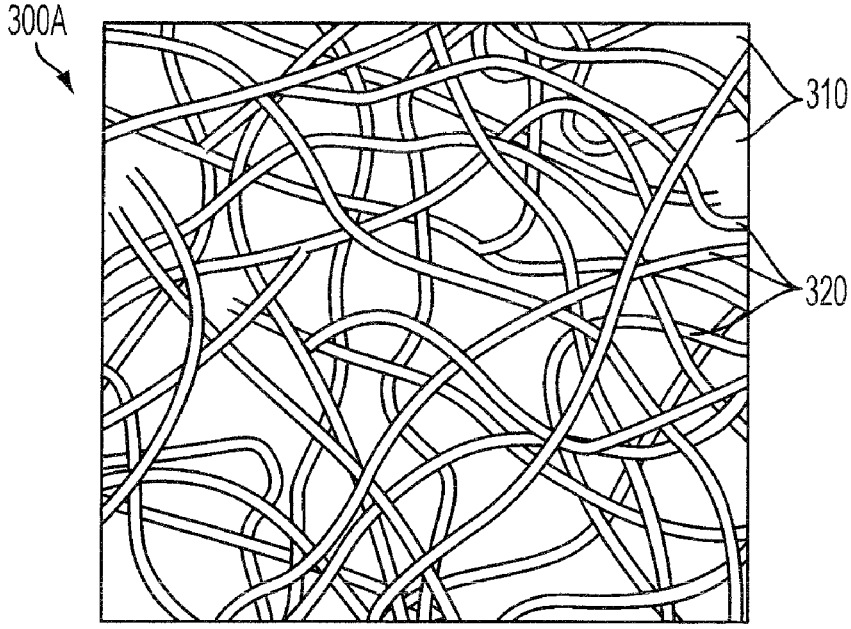
FIGS. 3A-3B depict portions of exemplary electrospun layers in accordance with various embodiments of the present teachings.
Figure 3B:
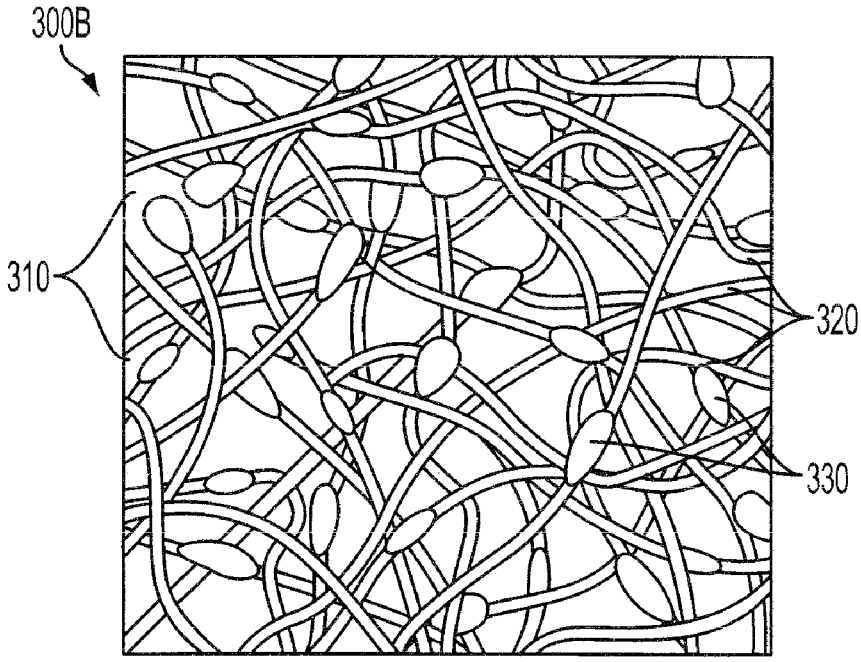

FIGS. 3A-3B depict portions of exemplary electrospun layers in accordance with various embodiments of the present teachings. Specifically, in FIG. 3A, the electrospun layer 300A can be formed by entangling an electrospun core-sheath nanofiber 320 (e.g., as shown in FIG. 1) to form, for example, a fiber-on-fiber type of structure. In FIG. 3B, the electrospun layer 300B can be formed by entangling an electrospun core-sheath nanofiber 320 that has one or more electrospun beads 330 formed on surfaces of the core-sheath nanofiber 320 and/or embedded, partially or wholly, within the core-sheath nanofiber 320. The electrospun layer 300B can thus have a bead-on-fiber type of structure. The core-sheath nanofiber 320 and/or the electrospun beads 330 can be generated during the electrospinning process.

In embodiments, the electrospun beads 330 can have an average size ranging from about 50 nm to about 10 μm, such as from about 500 nm to about 8 μm, for example from about 100 nm to about 5 μm.

The electrospun layer 300A-B can be porous, having a porosity ranging from about 10% to about 99° A, such as from about 50% to about 95%, for example from about 60% to about 80%. In embodiments, the porous structures or pores 310 of the electrospun layer 300A-B can have an average pore size in a range of from about 50 nm to about 50 μm, for example from about 100 nm to about 10 μm, such as from about 500 nm to about 5 μm.

Figure 4A:
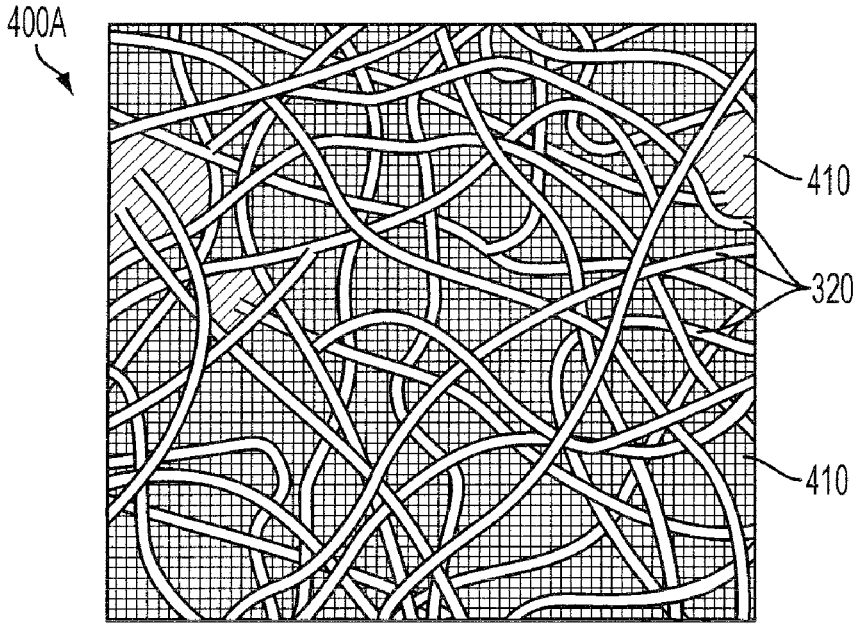
FIGS. 4A-4B depict portions of exemplary non-woven fabrics in accordance with various embodiments of the present teachings.
Figure 4B:
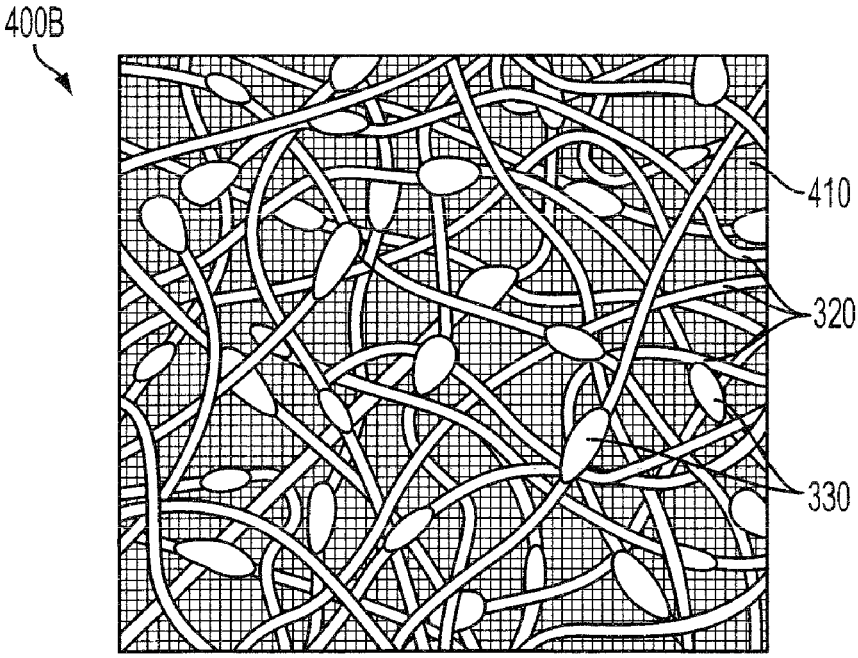

FIGS. 4A-4B depict portions of exemplary non-woven fabrics in accordance with various embodiments of the present teachings. in embodiments, the exemplary non-woven fabrics 400A-B can include an electrospun layer (e.g., the electrospun layer 300A-B in FIGS. 3A-3B) and at least one filler polymer 410. For example, the filler polymer 410 can be disposed within the pores 310 of the electrospun layer 300A-B. In embodiments, the at least one filler polymer 410 can partially or wholly fill the pores 310. In embodiments, the at least one filler polymer 410 can provide a polymer matrix for the non-woven fabric 400A-B.

Figure 2:
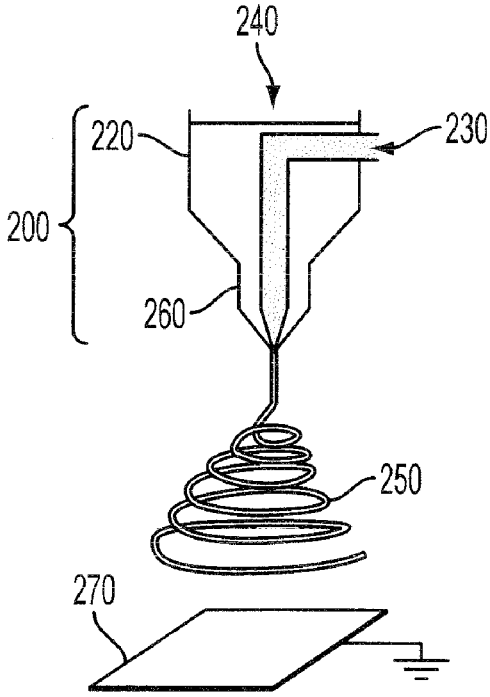
FIG. 2 depicts an exemplary electrospinning apparatus in accordance with various embodiments of the present teachings.

FIG. 2 depicts an exemplary electrospinning apparatus. Specifically, the exemplary electrospinning apparatus can be a coaxial electrospinning apparatus. A spinneret 200 can include a metal tip 260, and a first injector 210 and a second injector 220 arranged concentrically (e.g., the first injector 210 can concentrically surround a second injector 220, as shown in FIG. 2). In an embodiment, the second injector 220 can be inserted into the first injector 210. The first injector 210 can deliver an outer (sheath) solution 240 and the second injector 220 can deliver an inner (core) solution 230. In an embodiment, the inner and outer solutions 230, 240 can be delivered simultaneously'. Together, the inner and outer solutions 230, 240 can form an electrified jet 250 during extrusion when the metal tip 260 is electrified. The electrified jet 250 be collected on a collector 270.

Various materials can be used to form the core-sheath nanofibers 100, 320 including, but not limited to, polymers, ceramics, composites, and/or combinations thereof. Suitable synthetic and/or natural materials can be used. As disclosed herein, the core-sheath nanofibers 100, 320 can have a core material 110 surrounded by a sheath material 120.

Exemplary materials used for the core 110 can include high performance polymers, including organic polymers, inorganic polymers, and combinations thereof. As used herein, the term "high performance" is understood to have its ordinary meaning as known in the art. "High performance" typically refers to unusual stability upon exposure to harsh environments (e.g., high temperature), and having properties that surpass those of conventional polymers (e.g., high mechanical properties). See Hergenrother, Paul M., *The Use, Design,*

*Synthesis, and Properties of High Performance/High Temperature Polymers: An Overview, High Performance Polymers* (2003) 15: 3, the disclosure of which is incorporated herein by reference in its entirety. Exemplary high performance polymers include polyimides, polyamides, polyoxadiazoles, polybenzimidazoles, polyesters, poly(arylene ethers), polyketones, polyurethanes, polysulfides, polysulfones, polycarbonates, other like polymers, and combinations thereof. in embodiments, preferred core materials include polyamide (e.g., Nylon-6,6), polyimide, polyester, polybenzimidazole, poly(arylene ether), polysulfone, and combinations thereof.

Other suitable materials for the core 110 include composite and ceramic materials derived from sol-gel solutions. Any sot-gel solution known in the art for forming composite and ceramic materials on the nanoscale can be useful herein. As used herein, "sol-gel" is understood to have its ordinary meaning as understood in the art. Typically, in a sol-gel procedure, a solution ("sot") gradually evolves towards the formation of a gel-like ("gel") network containing both a liquid phase and a solid phase. The solid phase can have a basic structure or morphology ranging from discrete colloidal particles to continuous polymer networks. The sol can include metal alkoxides and/or metal chlorides, which undergo hydrolysis and polycondensation reactions to form a colloid. The liquid phase in the gel can be removed via a drying process to yield a solid composite or ceramic material.

In embodiments, preferred sol-gel solutions can include metal alkoxides such as $SiO_2$, $SnO_2$, indium tin oxide (ITO), $GeO_2$, $NiFeO_4$, $LiCoO_2$, $BaTiO_3$, $Al_2O_3$, CuO, NiO, $TiO_2$—$SiO_2$, $V_2O_5$, ZnO, $Co_3O_4$, $Nb_2O_5$, $MoO_3$, $MgTiO_3$, and the like, and combinations thereof. Sol-gels and methods thereof for use in producing composite and ceramic materials are described in *Electrospinning of Nanofibers: Reinventing the Wheel*?, Li, Dan and Xia, Younan, *Adv. Mater.* 2004, 16(14), July 19, and *A Method for Making Inorganic and Hybrid (Organic/Inorganic) Fibers and Vescicles with Diameters in the Submicrometer and Micrometer Range via Sol-Gel Chemistry and Electrically Forced Liquid Jets*, Larsen, Gustavo, et al., *J. Am. Chem. Soc.,* 2003, 125 (5), pp 1154-1155, the disclosures of which are incorporated herein by reference in their entirety.

Exemplary materials used for the sheath 120 can include solvent-soluble fluoropolymers, solvent-insoluble fluororesins, and combinations thereof. As used herein, "solvent-soluble" is understood to mean soluble in organic solvent alone. Conversely, "solvent-insoluble" is understood to mean not soluble in organic solvent alone. Exemplary sheath materials can have a surface energy of 25 mN/m or less, for example from about 25 mN/m to about 16 mN/m, such as from about 22 mN/m to about 15 mN/m or about 20 mN/m to about 10 mN/m.

Examples of suitable solvent-soluble fluoropolymers include fluoropolymers, fluorothermoplastics, fluoropolysiloxanes, and fluorinated polyimides. In embodiments, preferred solvent-soluble fluoropolymers include poly(vinylidene fluoride); copolymers of vinylidenefluoride and hexafluoropropylene; terpolymers of vinylidenefluoride, hexafluoropropylene and tetrafluoroethylene; and tetrapolymers of vinylidenefluoride, hexafluoropropylene, and tetrafluoroethylene. These fluoropolymers are known commercially under various designations as DYNEON™ THV, VITON A®, VITON E®, VITON E 60C®, VITON E430®, VITON 910®, VITON GH® and VITON GF®. The VITON® designation is a Trademark of E.I. DuPont de Nemours, Inc. and the DYNEON™ designation is a Trademark of 3M Company. Additional specific suitable fluoropolymers are those described in detail in U.S. Pat. Nos. 5,166,031, 5,281,506, 5,366,772, 5,370,931, 4,257,699, 5,017,432 and 5,061,965, the entire disclosures each of which are incorporated by reference herein in their entirety. Other commercially available fluoropolymers include FLUOREL 2170®, FLUOREL 2174®, FLUOREL 2176®, FLUOREL 2177® and FLUOREL LVS 76®. The FLUOREL® designation is a Trademark of 3M Company. Additional commercially available materials include AFLAS® a poly(propylene-tetrafluoroethylene) and FLUOREL II® (LII900) a poly(propylene-tetrafluoroethylenevinylidenefluoride) both also available from 3M Company, as well as the "Tecnoflons" identified as FOR60KIR®, FOR-LHF®, NM® FOR-THF®, FOR-TFS®, TH®, and TN505®, available from Montedison Specialty Chemical Company.

Examples of suitable solvent-insoluble fluororesins include fluoroplastics and fluorinated polyethers. In embodiments, preferred solvent-insoluble fluororesins include polytetrafluoroethylene (PTFE), perfluoroalkoxy polymer resin (PFA), poly(tetrafluoroethylene-co-perfluoropropyl vinyl ether), fluorinated ethylenepropylene copolymer (FEP), other like solvent-insoluble fluororesins, and combinations thereof. Commercially available solvent-insoluble fluororesins include TEFLON® PFA (polyfluoroalkoxypolytetrafluoroethylene), TEFLON® PTFE (polytetrafluoroethylene), or TEFLON® FEP (fluorinated ethylenepropylene copolymer), available from E.I. DuPont de Nemours, Inc. (Wilmington, Del.). The TEFLON® designation is a Trademark of E.I. DuPont de Nemours, Inc As disclosed herein, materials for the core 110 and sheath 120 can be dissolved or dispersed in solution to form inner (core) and outer (sheath) solutions 230, 240. In an aspect, material comprising the core 110 and material comprising the sheath 120 can be soluble or dispersible in different solutions. In an aspect, material comprising the core 110 can be soluble or miscible in the core solution 230. In other aspects, material comprising the sheath 120 can be soluble in the sheath solution 240 with or without a sacrificial polymeric binder.

In embodiments, material comprising the core 110 can be present in the core solution 230 in an amount ranging from about 1 to about 50 percent by weight, for example from about 5 to about 30 percent by weight, such as from about 8 to about 25 percent by weight of the core solution. In embodiments, solvent-soluble fluoropolymers comprising the sheath 120 can be present in the sheath solution 240 in an amount ranging from about 1 to about 50 percent by weight, for example, 5 to about 30 percent by weight, such as from about 8 to about 25 percent by weight of the sheath solution.

In embodiments utilizing solvent-insoluble fluororesins, the sheath solution 240 can further comprise a sacrificial polymeric binder to solubilize solvent-insoluble fluororesins in solution. Exemplary materials for the sacrificial polymeric binder can include poly(alkylene carbonates), preferably poly(propylene carbonate), poly (ethylene carbonate), poly (butylenes carbonate), poly(cyclohexene carbonate, and the like, and combinations thereof. Commercially available sacrificial polymeric binder materials can include poly(propylene carbonate) having a melting point of about 250° C. and produced through the copolymerization of carbon dioxide with one or more epoxides, available from Empower Materials (New Castle, Del.). The solvent-insoluble fluororesins can be present in the sheath solution 240, with a sacrificial polymeric binder, in an amount ranging from about 70 to about 99 percent, for example from about 80 to about 93 percent, such as from about 90 to about 95 percent, based on the amount of total solids in the sheath solution. The sacrificial polymeric binder can be present in the sheath solution 240 in an amount ranging from about 1 to about 30 percent, for example from about 3 to about 20 percent, such as from about 5 to about 10 percent, based on the amount of total solids in the sheath solution. Total solids content can be calculated by any known method in the art. See, e.g., *Determination of Total Solids in Resin Solutions*, McKinney et al., *Ind, Eng. Chem. Anal. Ed.,* 1946, 18 (1), pp 14-16.

In an aspect, sheath solutions including solvent-insoluble fluororesins can further include a surfactant. Any surfactant known in the art can be used. For example, the surfactant can be present in an amount ranging from about 0.1 to about 10 percent, preferably from about 1 to about 5 percent, based on the amount of total solids in the sheath solution.

Without being limited by theory, it is believed that the sacrificial polymeric binder can disperse solvent-insoluble fluororesins comprising the sheath 120 in solution (where it would otherwise be relatively insoluble or immiscible) during the electrospinning process, and the sacrificial polymeric binder can subsequently be removed (e.g., by decomposing, evaporating, burning away, or the like) after electrospinning at a temperature above its melting point. In this way, a material that is otherwise insoluble or immiscible in solvent may be used in coaxial electrospinning (which typically uses a highly viscous polymer solution) to form the sheath.

Depending on the materials used, the core solution and/or sheath solution can include a solvent. The solvent can be aqueous or organic solvent, or a mixture of aqueous and organic solvents. Exemplary organic solvents include acetone, methylethylketone, cyclohexanone, ethyl acetate, methoxy ethyl ether, methylene chloride, and the like, and combinations thereof. Furthermore, depending on the processing conditions (such as solvent, solution and/or dispersion concentration, temperature, voltage, and the like), the diameter of the core-sheath nanofiber 100, 320, the average pore size 310, and the porosity of the electrospun layer 300A-B can be controlled.

In embodiments, the core-sheath nanofiber 100, 320 can be generated by using electrospinning techniques, such as those described in U.S. Patent Publication No. 20060292369, the disclosure of which is incorporated herein by reference in its entirety. Methods for the preparation of ultrathin fibers by electrospinning are also disclosed in the review article *Electrospinning: A Fascinating Method for the Preparation of Ultrathin Fibers*, A. Greiner and J. Wendorff, *Angew. Chem. Int. Ed.,* 2007, 46(30), 5670-5703, the disclosure of which is incorporated herein by reference in its entirety. Furthermore, methods for the preparation of nanofibers by coaxial electrospinning are disclosed in the article *Direct Fabrication of Composite and Ceramic Hollow Nanofibers by Electrospinning*, D. Li and Y. Xia, *Nano Letters,* 2004, 4(5), 933-938, the disclosure of which is incorporated herein by reference in its entirety.

As disclosed herein, a core-sheath nanofiber 100, 320 can be generated by coaxial electrospinning. As shown in FIG. 2, the first injector 210 can deliver an outer (sheath) material solution 240 and the second injector 220 can deliver an inner (core) material solution 230. When extruded simultaneously through an electrified metal tip 260, the inner and outer material solutions 230, 240 can form an electrified jet 250. The electrified jet 250 can be continuously stretched due to electrostatic forces between surface charges and form core-sheath nanofibers 100, 320. In aspects, the core-sheath nanofibers 100, 320 can form an electrospun layer 300A-B.

The core-sheath nanofibers 100, 320 can subsequently be heated to a first temperature at or above the melting point of the sacrificial polymeric binder but below the melting point of material comprising the sheath 120, and then heating to a second temperature at or above the melting point of the material comprising the sheath 120. For example, the core-sheath nanofibers 100, 320 can be heated to a first temperature ranging from about 100° C. to about 280° C., such as from about 150° C. to about 270° C., for example from about 200° C. to about 250° C. Without being limited by theory, it is believed that heating to the first temperature removes (e.g., by decomposing, evaporating, burning away, or the like) the sacrificial polymeric binder from the sheath 120. However, a trace amount of the binder may be left in the sheath 120 due to incomplete removal.

The core-sheath nanofibers 100, 320 can be heated to a second temperature ranging from about 285° C. to about 380° C., such as from about 300° C. to about 360° C., for example from about 310° C. to about 350° C. Heating to the second temperature can melt the material comprising the sheath to form a continuous coating, i.e., sheath 120, on the core surface, e.g., forming a solid core-sheath nanofiber 100, 320.

Following the second heating of the core-sheath nanofibers 100A, the non-woven fabrics 400A-B can be formed by, e.g., casting a homogeneous solution containing one or more filler polymers onto the formed electrospun layer 300A-B.

This can be followed by a solidifying process, e.g., a drying or curing process, to remove the solvent of the homogeneous solution, thereby leaving solidified filler polymers (see 410 of FIGS. 4A-4B) within the pores 310 of the electrospun layers 300A-B. The casting process can include any suitable casting processes known to one of ordinary skill in the art.

In some cases, the selected filler polymers may not form homogeneous solution, but may be in a form of particles or powders contained in a heterogeneous dispersion. The heterogeneous dispersion can then be cast onto the electrospun layers 300A-B, followed by a solidifying process to remove the dispersion solvent. In addition, a melting process can be used to melt the particles or powders of the filler polymers. The melted filler polymers (see 410 in FIGS. 4A-4B) can then be dispersed within the pores 310 of the electrospun layers 300A-B to form the disclosed non-woven fabrics 400A-B.

In other cases, particles or powders of filler polymers can be applied directly to the electrospun layer 300A-B without using a dispersion solvent, but using a melting process. The applied filler polymer particles 410 can thus be melted into the pores 310 of the electrospun layer 300A-B to form the disclosed non-woven fabrics 400A-B.

in embodiments, the filler polymers 410 can include, but are not limited to, fluoropolymers, silicone elastomers, thermoelastomers, resin, polyamides, polyesters, polyimides, polycarbonates, polyurethanes, polyethers, polyoxadazoles, polybenzimidazoles, polyacrylonitriles, polyethylenes, polypropylenes, polybutadienes, polystyrenes, and/or combinations thereof. Exemplary materials for the filler polymers 410 can include acrylonitrile butadiene styrene (ABS), polymethyl-methacrylate (PMMA), polyhedral oligomeric silsesquioxane (POSS), poly(vinyl alcohol), poly(ethylene oxide), polylactide, poly(caprolactone), poly(ether imide), poly (ether urethanes), poly(ester urethanes), poly(p-phenylene terephthalate), cellulose acetate, poly(vinyl acetate), poly (acrylic acid), polyacrylamide, polyvinylpyrrolidone, hydroxypropylcellulose, poly(vinyl butyral), poly(alkly acrylates), poly(alkyl methacrylates), polyhydroxybutyrate, fluoropolymer, poly(vinylidene fluoride), poly(vinylidene fluoride-co-hexafluoropropylene), fluorinated ethylene-propylene copolymer, poly(tetrafluoroethylene-co-perfluoropropyl vinyl ether), poly((perfluoroalkyl)ethyl methacrylate), cellulose, chitosan, gelatin, protein, nylon, fluoroelastomer, fluoroplastic, silicone elastomer, thermoelastomer, resin, fluororesin, and combinations thereof.

Suitable fluoropolymers can include fluoroplastics, fluoroelastomers, and/or fluororesins and can include one or more fluoro-materials selected from the group consisting of polytetrafluoroethylene (PTFE), perfluoroalkoxy polymer resin (PFA), fluorinated ethylenepropylene copolymer (FEP), copolymers of tetrafluoroethylene (TFE) and hexafluoropropylene (HFP), copolymers of hexafluoropropylene (HFP) and vinylidene fluoride (VDF), terpolymers of tetrafluoroethylene (TFE), vinylidene fluoride (VDF), and hexafluoropropylene (HFP), and tetrapolymers of tetrafluoroethylene (TFE), vinylidene fluoride (VF2), and hexafluoropropylene (HFP).

Additionally, commercially available fluoroplastics can include those from various designations, such as TEFLON® PFA, TEFLON® PTFE, or TEFLON® FEP available from E.I. DuPont de Nemours, Inc, (Wilmington, Del.).

Commercially available fluoroelastomers can include, for example, VITON® A: copolymers of HFP and VDF (or VF2); VITON® B: terpolymers of TFE, VDF and HFP; VITON® GF: tetrapolymers of TFE, VF2, HFP; as well as VITON® E; VITON® VITON® E430; VITON® 910; VITON® GF; and VITON® GF. The VITON® designations are Trademarks of E.I. DuPont de Nemours, Inc. (Wilmington, Del.). Other commercially available fluoroelastomers can include those available from 3M Corporation (St. Paul, Minn.) including, for example, DYNEON™ fluoroelastomers, AFLAS® fluoroelastomers (e.g., a poly(propylene-tetrafluoroethylene)), and FLUOREL® fluoroelastomers (e.g. FLUOREL® II (e.g., LII900) a poly(propylene-tetrafluoroethylenevinylidenefluoride), FLUOREL® 2170, FLUOREL® 2174, FLUOREL® 2176, FLUOREL® 2177, and/or FLUOREL® LVS 76. Additional commercially available fluoroelastomer materials can include the "tecnoflons" identified as FOR®-60KIR, FOR®-LHF, FOR®-NM, FOR®-THF, FOR®-TFS, FOR®-TH, and FOR®-TN505, available from Solvay Solexis (West Deptford, N.J.).

In embodiments, the filler polymers 410 can include materials used for forming the sheath 120 of the core-sheath nanofibers 100, 320, and vice versa.

The materials used for the sheath 120 and for the filler polymers 410 can be the same or different. In this way, without being limited by theory, it is believed that the disclosed core-sheath nanofibers 100, 320 can have improved compatibility with the polymer matrix (e.g., filler polymer 410) of the non-woven fabrics 400A-B, without affecting advantageous properties of the non-woven fabrics 400A-B (for example, surface properties, chemical properties, and the like.) Additionally, by selecting suitable combination of materials and/or amounts of core-sheath nanofibers 100, 320 and filler polymers 410, the properties of the resulting non-woven fabrics 400A-B can be adjusted or controlled as desired.

The core-sheath nanofibers 100, 320 can provide a long length, an ultrathin diameter, and capability of being aligned on the molecular level. The resultant electrospun layer can possess many exceptional properties, such as, for example, high mechanical strength, high surface area, and other tunable mechanical, surface, electrical, thermal, and/or chemical properties, depending on the selection of the polymers and morphology of the generated electrospun fibers/layers.

In embodiments, the core-sheath nanofibers 100, 320 can have at least one dimension, e.g., a width or diameter, of less than about 500 nm, for example, ranging from about 1 nm to about 100 nm, or from 1 nm to about 50 nm. Because of the high surface-to-volume ratio of the core-sheath polymer nanofibers, the interaction between the core-sheath nanofibers 100, 320 and filler polymers 410 can be significantly increased, leading to better mechanical reinforcement than conventional fibers. Additionally, the core-sheath nanofibers 100, 320 can be ultra-fine and can provide a high weight loading in the resulting non-woven fabrics 400A-B. Further, due to use of the disclosed core-sheath nanofibers 100, 320, the resultant non-woven fabrics 400A-B can have uniform, well-controlled surface morphology, e.g., for providing ultra-low surface energy useful for oil-less fusing processes. Furthermore, the resulting non-woven fabrics 400A-B can provide tunable properties including, but not limited to, mechanical robustness, surface properties, and/or electrical-, thermal-, and/or chemical properties.

The sheath 120 of the core-sheath nanofibers 100, 320 can have at least one dimension, e.g., a width or diameter, of from about 1 nm to about 5 μm, for example from about 3 nm to about 3 μm, such as from about 5 μm to about 1 μm. The core 110 of the core-sheath nanofibers 100, 320 can have at least one dimension e.g., a width or diameter, of from about 1 nm to about 100 μm, for example from about 5 nm to about 50 μm, such as from about 10 nm to about 10 μm.

The non-woven fabrics 400A-B can have desirable surface energy, for example, a surface energy ranging from about 25 $mN/m^2$ to about 1 $mN/m^2$, or from about 22 $mN/m^2$ to about 5 $mN/m^2$, or from about 20 $mN/m^2$ to about 10 $mN/m^2$. This low surface energy can control surface release performance of the non-woven fabrics/nanofabrics. For example, when the non-woven fabrics are used as a topcoat layer of a fuser member in an electrophotographic printing device, an oil-less fusing process can be performed.

The non-woven fabrics 400A-B can provide desirable mechanical properties. For example, the non-woven fabrics 400A-B can have a tensile strength ranging from about 500 psi to about 5,000 psi, or from about 1,000 psi to about 4,000 psi, or from about 1,500 psi to about 3,500 psi; an elongation % ranging from about 20% to about 1000%, or from about 50% to about 500%, or from about 100% to about 400%; a toughness ranging from about 500 in.-lbs./$in.^3$ to about 10,000 in.lbs./$in.^3$, or from about 1,000 in.-lbs./$in.^3$ to about 5,000 in.-lbs./$in.^3$, or from about 2,000 in.-lbs./$in.^3$ to about 4,000 in.-lbs./$in.^3$; and an initial modulus ranging from about 100 psi to about 2,000 psi, or from about 500 psi to about 1,500 psi, or from about 800 psi to about 1,000 psi.

The non-woven fabrics 400A-B can have a desirable thermal diffusivity ranging from about 0.01 $mm^2/s$ to about 0.5 $mm^2/s$, or from about 0.05 $mm^2/s$ to about 0.25 $mm^2/s$, or from about 0.1 $mm^2/s$ to about 0.15 $mm^2/s$, and a desirable average thermal conductivity ranging from about 0.01 W/mK to about 1.0 W/mK, or from about 0.1 W/mK to about 0.75 W/mK, or from about 0.25 W/mK to about 0.5 W/mK.

in embodiments, the non-woven fabrics 400A-B can be used in any suitable electrophotographic members and devices. For example, the non-woven fabrics 400A-B can be used as a topcoat layer for a printer member in electrophotographic devices including, but not limited to, a fuser member, a pressure member, and/or a donor member. The topcoat layer can be thin and can have a thickness ranging from about 50 nm to about 3 μm, or from about 100 nm to about 3 μm, or from about 500 nm to about 2 μm.

The printer member can be in a form of, for example, a roll, a drum, a cylinder, or a roll member as shown in FIGS. 5A-5B and FIGS. 6A-6B. In some embodiments, the printer member can be in a form of a belt, a belt, a plate, a sheet, or a belt member as shown in FIGS. 7A-7B and FIGS. 8A-8B.

Figure 5A:
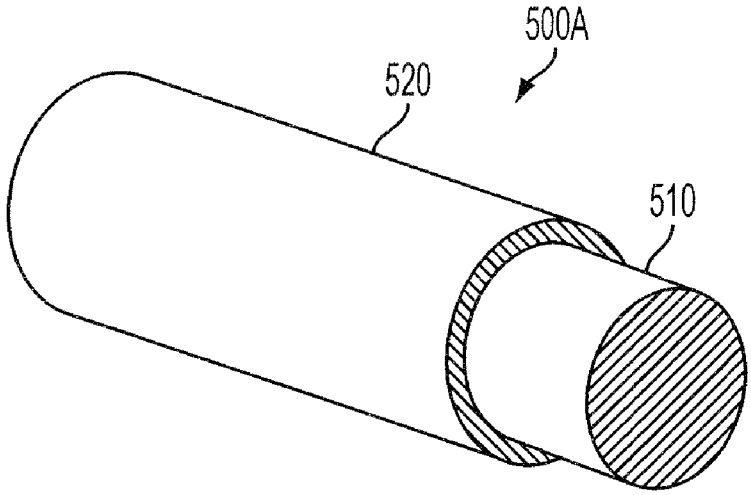
FIGS. 5A-5B depict exemplary fuser rolls having the exemplary non-woven fabrics disclosed herein in accordance with various embodiments of the present teachings.
Figure 5B:
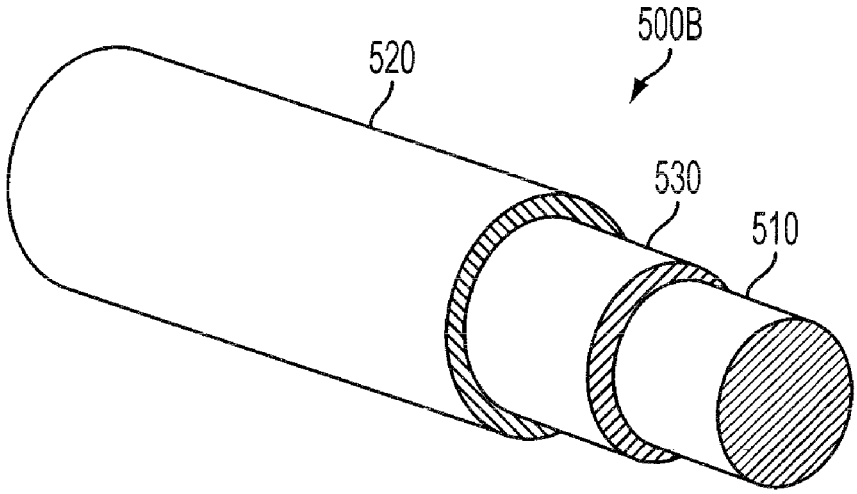

Referring to FIGS. 5A-5B, the fuser member 500A-B can include a substrate 500 and a topcoat layer 520 formed over the substrate 510. The topcoat layer 520 can include, for example, the non-woven fabrics 400A-B as shown in FIGS. 4A-4B.

In embodiments, the substrate 510 can be a cylindrical substrate taking the form of a cylindrical tube, e.g., having a hollow structure including a heating lamp therein, or a solid cylindrical shaft. The substrate 510 can be made of a material including, but not limited to, a metal, a polymer (e.g., plastic), and/or a ceramic. For example, the metal can include aluminum, anodized aluminum, steel, nickel, and/or copper. The plastic can include, for example, polyimide, polyester, polyketone such as polyetheretherketone (PEEK), poly (arylene ether), polyamide, polyaramide, polyetherimide, polyphthalamide, polyamide-imide, polyphenylene sulfide, fluoropolyimide and/or fluoropolyurethane.

The topcoat layer 520 can be formed directly on the substrate 510 as exemplarily shown in FIG. 5A. In various embodiments, one or more additional functional layers, depending on the member applications, can be formed between the topcoat layer 520 and the substrate 510. For example, the member 500B can have a 2-layer configuration having a compliant/resilient layer 530, such as a silicone rubber layer, disposed between the topcoat layer 520 and the substrate 510. In another example, the exemplary fuser member can include an adhesive layer (not shown), for example, formed between the resilient layer 530 and the substrate 510 or between the resilient layer 530 and the topcoat layer 520.

Figure 6A:
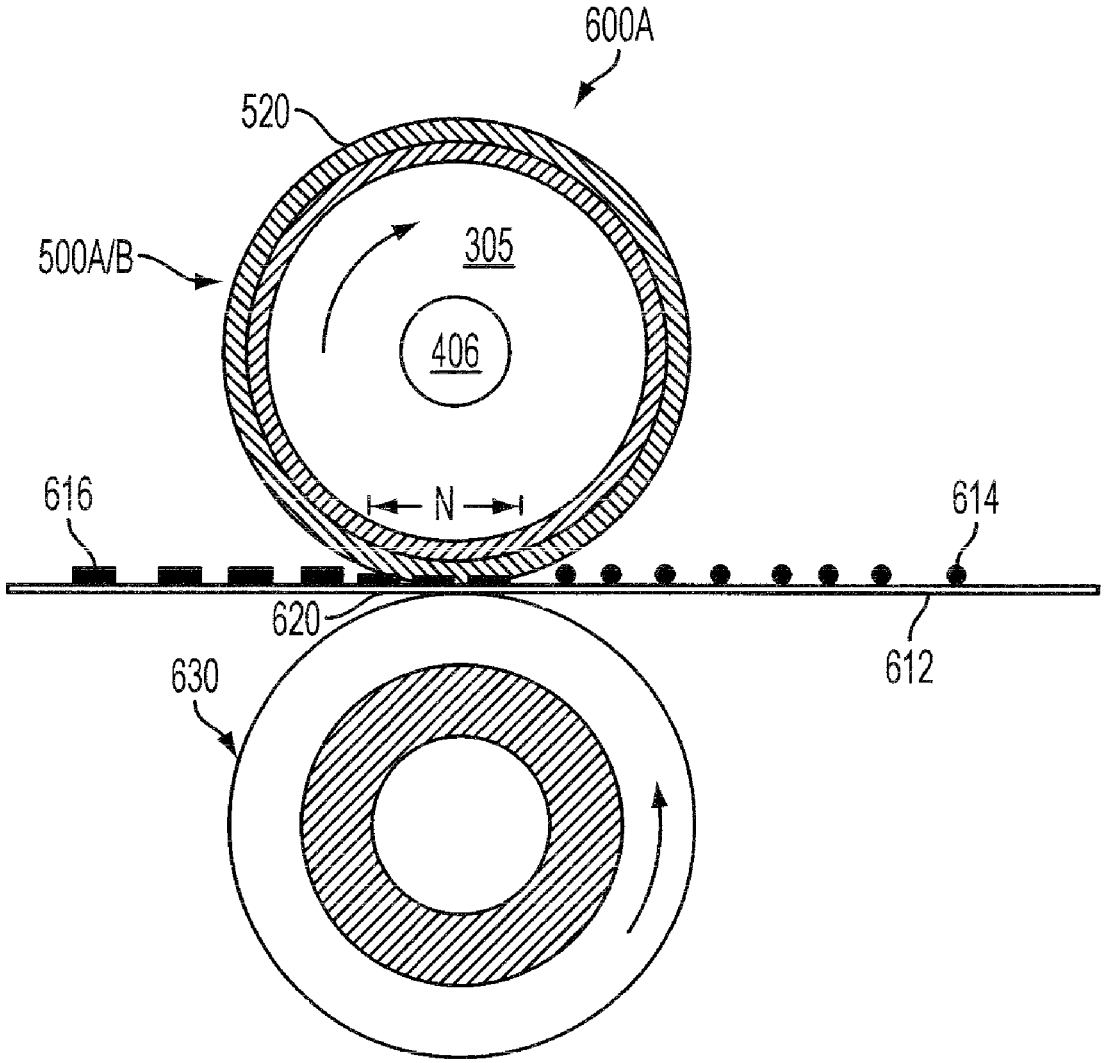
FIGS. 6A-6B depict exemplary fusing apparatuses having the fuser rolls of FIGS. 5A-5B in accordance with various embodiments of the present teachings.
Figure 6B:
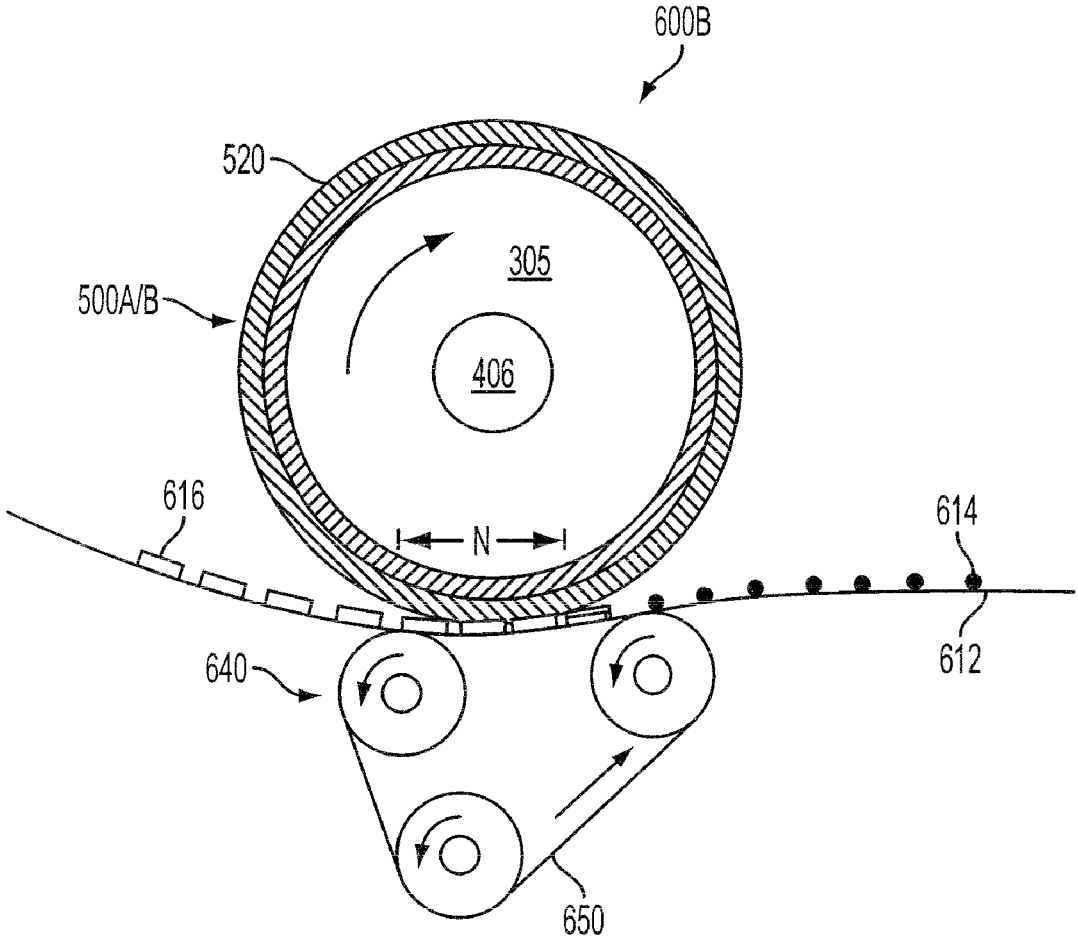

As disclosed herein, the exemplary fuser member 500A-B can be used in a conventional fusing system to improve fusing performances. FIGS. 6A-6B depict exemplary fusing apparatuses 600 A-B using the disclosed member 500A or 500B of FIGS. 5A-5B.

The exemplary fusing apparatuses 600A-B can include the exemplary fuser member 500A/B having a topcoat layer 520 over a suitable substrate 510, e.g., a hollow cylinder fabricated from any suitable metal. The fuser member 600A/B can further be incorporated with a suitable heating element 610 disposed in the hollow portion of the substrate 510 which is coextensive with the cylinder. Backup (or pressure) roll 630 (see FIG. 6A) or a backup (or pressure) belt 650 (see FIG. 6B) can cooperate with the fuser member 600A/B to form a contact nip N through which a print medium 612 such as a copy paper or other print substrate passes, such that toner images 614 on the print medium 612 contact the topcoat layer 520 during the fusing process. The mechanical component 635 can include one or more rolls cooperated to move the pressure belt 618. The fusing process can be performed at a temperature ranging from about 60° C. (140° F.) to about 300° C. (572° F.), or from about 93° C. (200° F.) to about 232° C. (450° F.), or from about 160° C. (320° F.) to about 232° C. (450° F.). Following the fusing process, after the print medium 612 passing through the contact nip N, fused toner images 616 can be formed on the print medium 612.

Figure 7A:
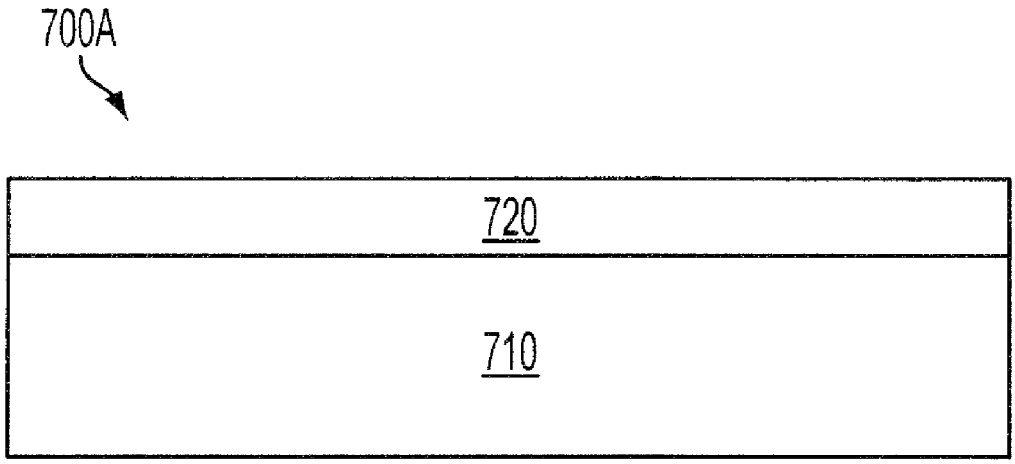
FIGS. 7A-7B depict exemplary fuser belts having the exemplary non-woven fabric disclosed herein in accordance with various embodiments of the present teachings.
Figure 7B:
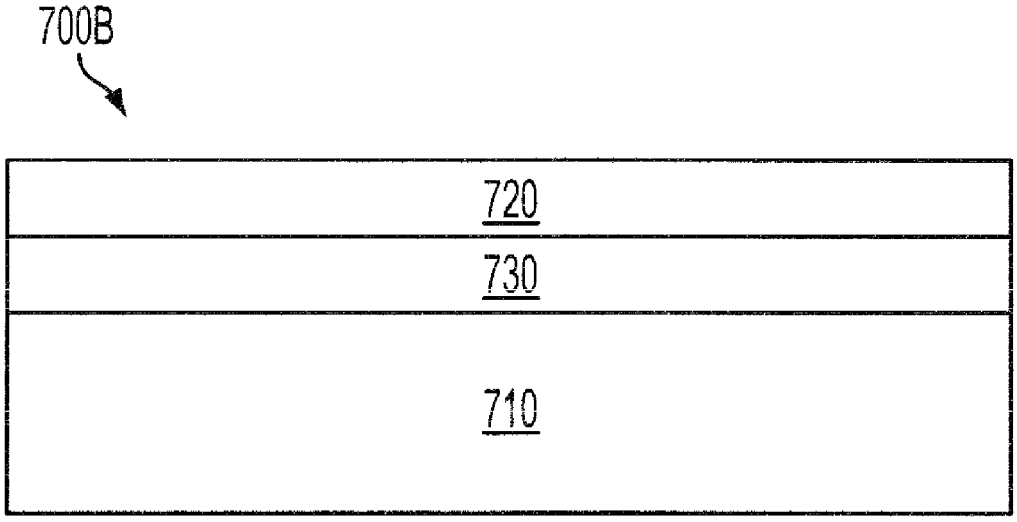

In embodiments, the fuser member can be a fuser belt having a topcoat layer 720 formed over a belt substrate 710 as shown in FIGS. 7A-7B. In other embodiments, a layer 730 (e.g., a compliant/resilient layer or adhesive layer) can be disposed between the topcoat layer 720 and the substrate 710. As described herein, the topcoat layer 720 can include the non-woven fabrics 400A-B disclosed herein.

Compared with the fuser rolls 500A-B shown in FIGS. 5A-5B, the fuser belts 700A-B can have the belt substrate 710. The belt substrate 710 can be any suitable belt substrate as known to one of ordinary skill in the art. For example, the belt substrate 710 can include high temperature plastics that are capable of exhibiting a high flexural strength and high modulus. The belt substrate 710 can alternatively include a film, sheet, or the like and can have a thickness ranging from about 25 micrometers to about 250 micrometers. The belt substrate 710 can include, for example, polyimide, polyester, polyketone such as polyetheretherketone (PEEK), poly (arylene ether), polyamide, polyaramide, polyetherimide, polyphthalamide, polyamide-imide, polyphenylene sulfide, fluoropolyimide and/or fluoropolyurethane.

Figure 8B:
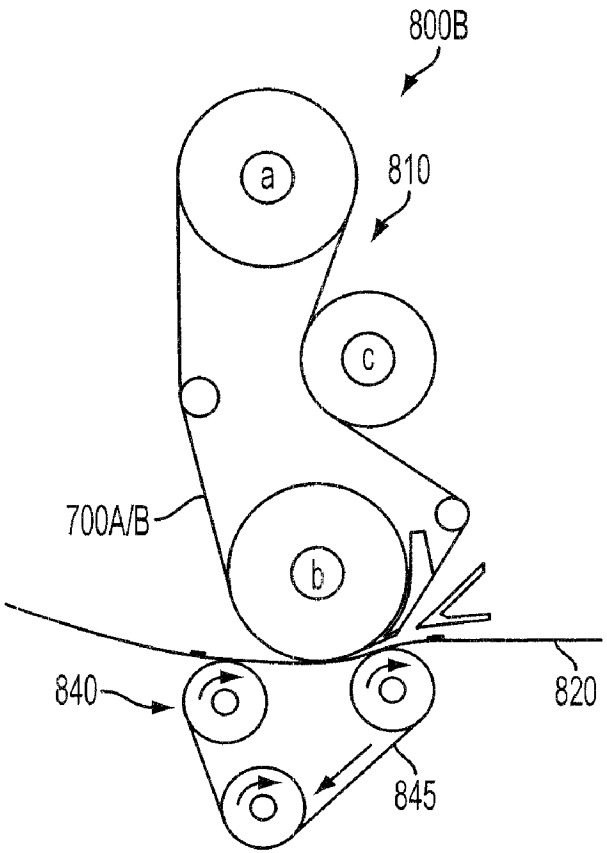
FIGS. 8A-8B depict exemplary fusing apparatuses having the fuser belts of FIGS. 7A-7B in accordance with various embodiments of the present teachings.
Figure 8A:
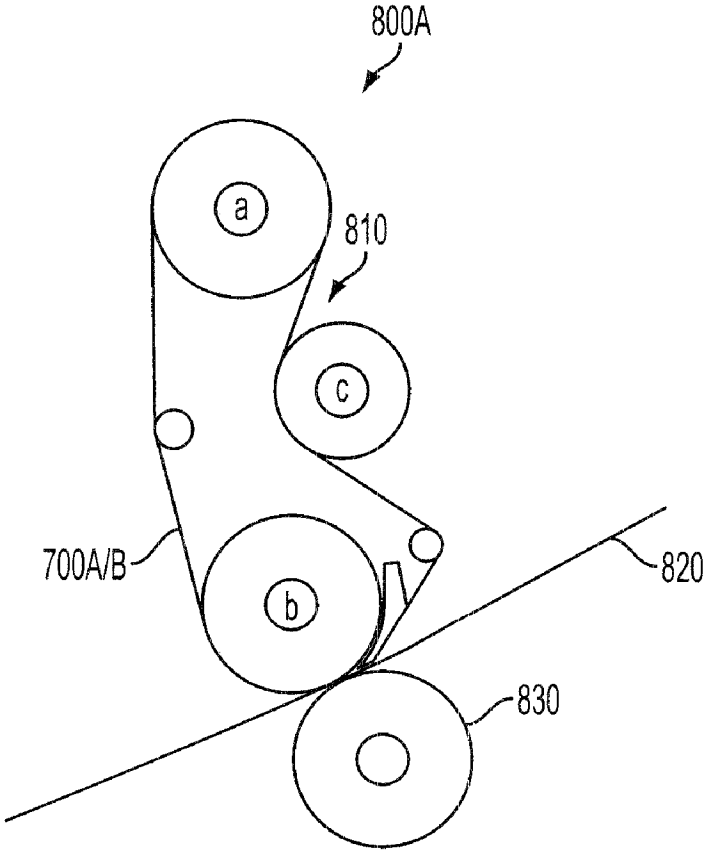

FIGS. 8A-8B depict exemplary fusing apparatuses 800A-B using the fuser belt shown in FIGS. 7A-7B in accordance with various embodiments of the present teachings. The apparatus 800A/B can include a fuser belt 700A/B that forms a contact nip with, for example, a pressure roll 830 in FIG. 8A or a pressure belt 845 of FIG. 6B. A print medium 820 having unfixed toner images (not illustrated) can then pass through the contact nip N to fuse the unfixed toner images on the print medium 820. In embodiments, the pressure roll 830 or the pressure belt 845 can be used in a combination with a heat lamp to provide both the pressure and heat for fusing the toner images on the print medium 820. In addition, the apparatus 800A/B can include a mechanical component 810 to move the fuser belt 700A/B and thus fusing the toner images and forming images on the print medium 820. The mechanical component 810 can include one or more rolls 810*a-c*, which can also be used as heat rolls when needed.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A method of forming core-sheath nanofibers by coaxial electrospinning comprising:

providing a core solution comprising a high performance polymer selected from the group consisting of an organic polymer, an inorganic polymer, and combinations thereof;

providing a sheath solution comprising a solvent-insoluble fluororesin, a sacrificial polymeric binder, and solvent;

coaxial electrospinning the core and sheath solutions to form a plurality of core-sheath polymer nanofibers, wherein the core solution forms a polymer core and the sheath solution forms a polymer sheath surrounding the core;

heating the core-sheath nanofibers to a first temperature ranging, from about 100° C. to about 280° C.; and heating the core-sheath nanofibers to a second temperature ranging from about 285° C. to about 380° C.

2. The method of claim 1, wherein the high performance polymer is selected from the group consisting of polyimides, polyamides, polyoxadiazoles, polybenzimidazoles, polyesters, poly(arylene ethers), polyketones, polyurethanes, polysulfides, polysulfones, polycarbonates, and combinations thereof.

3. The method of claim 1, wherein the solvent-insoluble fluororesin is selected from the group consisting of polytetrafluoroethylene (PTFE), perfluoroalkoxy polymer resin (PFA), poly(tetrafluoroethylene-co-perfluoropropyl vinyl ether), fluorinated ethylenepropylene copolymer (FEP), and combinations thereof.

4. The method of claim 1, wherein the sacrificial polymeric binder is a poly(alkylene carbonate).

5. The method of claim 4, wherein the poly(alkylene carbonate) is selected from the group consisting of poly(propylene carbonate), poly(ethylene carbonate), poly(butylenes carbonate), poly(cyclohexene carbonate), and combinations thereof.

6. The method of claim 1, wherein the solvent is selected from the group consisting of acetone, methylethylketone, cyclohexanone, ethyl acetate, methoxy ethyl ether, methyl chloride, and combinations thereof.

7. The method of claim 1, wherein the core solution comprises a sol-gel solution comprising a metal oxide.

8. The method of claim 7, wherein the metal oxide is selected from the group consisting of $SiO_2$, $SnO_2$, indium tin oxide (ITO), $GeO_2$, $NiFeO_4$, $LiCoO_2$, $BaTiO_3$, $Al_2O_3$, CuO, NiO, $TiO_2$—$SiO_2$, $V_2O_5$, ZnO, $Co_3O_4$, $Nb_2O_5$, $MoO_3$, $MgTiO_3$, and combinations thereof.

9. A method of forming core-sheath nanofibers by coaxial electrospinning comprising:

providing a core solution comprising a high performance polymer selected from the group consisting of an organic polymer, an inorganic polymer, and combinations thereof;

providing a sheath solution comprising a solvent-soluble fluoropolymer;

coaxial electrospinning the core and sheath solutions to form a plurality of core-sheath polymer nanofibers, wherein the core solution forms a polymer core and the sheath solution forms a polymer sheath surrounding the core;

heating the core-sheath nanofibers to a first temperature ranging from about 100° C. to about 280° C.; and heating the core-sheath nanofibers to a second temperature ranging from about 285° C. to about 380° C.

10. The method of claim 9, wherein the high performance polymer is selected from the group consisting of polyimides, polyamides, polyoxadiazoles, polybenzimidazoles, polyesters, poly(arylene ethers), polyketones, polyurethanes, polysulfides, polysulfones, polycarbonates, and combinations thereof.

11. The method of claim 9, wherein the solvent-soluble fluoropolymer is selected from the group consisting of poly (vinylidene fluoride); copolymer of vinylidene fluoride and hexafluoropropylene; copolymer of tetrafluoroethylene and vinylidene fluoride; terpolymer of tetrafluoroethylene, vinylidene fluoride and hexafluoropropylene; and combinations thereof.

12. The method of claim 9, wherein the core solution comprises a sol-gel solution comprising a metal oxide.

13. The method of claim 12, wherein the metal oxide is selected from the group consisting of $SiO_2$, $SnO_2$, indium tin oxide (ITO), $GeO_2$, $NiFeO_4$, $LiCoO_2$, $BaTiO_3$, $Al_2O_3$, CuO, NiO, $TiO_2$—$SiO_2$, $V_2O_5$, ZnO, $Co_3O_4$, $Nb_2O_5$, $MoO_3$, $MgTiO_3$, and combinations thereof.

* * * * *